US011696867B2

(12) United States Patent
Hanada et al.

(10) Patent No.: US 11,696,867 B2
(45) Date of Patent: Jul. 11, 2023

(54) MASSAGE MACHINE

(71) Applicant: FUJI MEDICAL INSTRUMENTS MFG. CO., LTD., Osaka (JP)

(72) Inventors: Tsukasa Hanada, Kyoto (JP); Toshihisa Yoshida, Osaka (JP)

(73) Assignee: FUJI MEDICAL INSTRUMENTS MFG. CO., LTD., Osaka (JP)

( * ) Notice: Subject to any disclaimer, the term of this patent is extended or adjusted under 35 U.S.C. 154(b) by 416 days.

(21) Appl. No.: 16/588,053

(22) Filed: Sep. 30, 2019

(65) Prior Publication Data

US 2020/0129370 A1 Apr. 30, 2020

(30) Foreign Application Priority Data

Oct. 25, 2018 (JP) ..... 2018-201047

(51) Int. Cl.
*A61H 7/00* (2006.01)

(52) U.S. Cl.
CPC ..... *A61H 7/007* (2013.01); *A61H 2201/0103* (2013.01); *A61H 2201/1215* (2013.01);
(Continued)

(58) Field of Classification Search
CPC ..... A61H 7/00; A61H 7/007; A61H 7/004; A61H 7/002; A61H 2007/009; A61H 15/0078
See application file for complete search history.

(56) References Cited

U.S. PATENT DOCUMENTS 4,009,710 A * 3/1977 Inada ..... A61H 15/0078 601/108
5,792,080 A * 8/1998 Ookawa ..... A61H 15/0078 601/134
(Continued)

FOREIGN PATENT DOCUMENTS

EP 1433454 A1 * 6/2004 ..... A61H 15/0078
JP 2002345913 A 12/2002
(Continued)

OTHER PUBLICATIONS

Japanese Office Action dated May 10, 2022 in Japanese Application No. 2018-201047, 6 pages with translation.

*Primary Examiner* — Bradley H Philips
*Assistant Examiner* — Savannah L Gabriel
(74) *Attorney, Agent, or Firm* — Masuvalley & Partners; Peter R. Martinez

(57) ABSTRACT

Under the control of a controller, a drive mechanism portion moves a massaging member and an ascent-descent mechanism moves up and down the massaging member together with the entire drive mechanism portion. During an ordinary kneading massage, the massaging member performs a relative motion to describe a reference locus in the shape of a closed curve. The controller controls to make the massaging member perform a relative reciprocating movement within a partial movement range corresponding to a partial segment of the reference locus and simultaneously controls to make the ascent-descent mechanism move the drive mechanism portion up and down. The relative reciprocating movement of the massaging member along the partial segment of the reference locus and the up-down movement of the entire drive mechanism portion are combined together to produce a new motion of the massaging member describing a locus different from the reference locus.

8 Claims, 16 Drawing Sheets

(52) U.S. Cl.
CPC ..... *A61H 2201/1623* (2013.01); *A61H 2201/1661* (2013.01); *A61H 2201/1676* (2013.01); *A61H 2203/0431* (2013.01)

(56) References Cited

U.S. PATENT DOCUMENTS

| | | | | |
|---|---|---|---|---|
| 2004/0025239 | A1* | 2/2004 | Pagano | E04H 4/10 4/503 |
| 2005/0010144 | A1* | 1/2005 | Chen | A61H 15/0078 601/102 |
| 2005/0090770 | A1* | 4/2005 | Chen | A61H 15/0078 601/102 |
| 2005/0192520 | A1* | 9/2005 | Morita | A61H 7/00 601/99 |
| 2007/0167887 | A1* | 7/2007 | Tsukada | A61H 15/0078 601/97 |
| 2008/0200849 | A1* | 8/2008 | Hollington | A61H 15/0078 601/46 |
| 2014/0343467 | A1* | 11/2014 | Fukuyama | A61H 9/0078 601/98 |
| 2017/0258673 | A1 | 9/2017 | Inada et al. | |
| 2017/0281455 | A1* | 10/2017 | Yoshida | A61H 7/007 |
| 2020/0121549 | A1* | 4/2020 | Inada | A61H 15/0078 |

FOREIGN PATENT DOCUMENTS

| | | | |
|---|---|---|---|
| JP | 2007215555 | A | 8/2007 |
| JP | 2008-302059 | A | 12/2008 |
| JP | 2010517610 | A | 5/2010 |
| JP | 2016083334 | A | 5/2016 |

* cited by examiner

MASSAGE MACHINE

This nonprovisional application claims priority under 35 U.S.C. § 119(a) on Patent Application No. 2018-201047 filed in Japan on Oct. 25, 2018, the entire contents of which are hereby incorporated by reference.

BACKGROUND OF THE INVENTION

1. Field of the Invention

The present invention relates to a massage machine that administers a massage such as kneading to a user by moving a massaging member with the user's body supported on a backrest portion.

2. Description of Related Art

A massage machine (for example, a chair-type massage machine) that performs a massage while supporting the user's body is so configured that, after the up-down position of a massaging member provided as a massage mechanism in a backrest portion is adjusted to suit the user's physical build, the massaging member is moved repeatedly against the user leaning on the backrest portion so that a massage such as kneading and tapping is administered to the user.

In some of such massage machines, not only is a drive mechanism for the massaging member operated to make the massaging member simply perform a motion that effects a kneading massage, the motion of the massaging member that effects a kneading massage is coordinated with an up-down movement of the massaging member together with the entire drive mechanism. The aim is to stimulate an area near the user's spine to achieve an outstanding massaging effect. An example of such conventional massage machines is seen in Japanese Patent Application published as No. 2008-302059.

The massage machine disclosed in JP-A-2008-302059 can administer treatment more effective than a simple kneading massage. However, the motion of the massaging member remains the same as that for an ordinary kneading massage, and thus it is possible to administer only a limited variety of motions. That is, it is not possible to make the massaging member perform a motion smaller than the orbit of a kneading motion, and this makes it difficult to perform with the massaging member a wide variety of massages conventionally sought after.

Moreover, the motion of the massaging member is larger than that possible with the human hand and fingers, and thus it is impossible to administer a stimulus comparable with that of a massage to an area smaller than the target area of an ordinary kneading massage. A massage to an area smaller than the target area of an ordinary kneading massage is, for example, a press-and-knead massage (in which muscle tissue as the massage target is pressed vertically and then, with the pressure maintained, the muscle tissue is moved in a circle or a line) using the human thumb or wrist.

SUMMARY OF THE INVENTION

The present invention is devised to solve the problems mentioned above, and is aimed at providing a massage machine that combines the motions of a plurality of mechanisms able to move a massaging member to produce a new motion of the massaging member, thereby contributing to a wider variety of massages, and that can administer a massage even to a small massage target without strain.

According to one aspect of the present invention, a massage machine that includes in a backrest portion a massage mechanism with a massaging member and that can administer with the massaging member a massage to a user while supporting the user's body at least on the backrest portion includes: a drive mechanism portion that has a stationary portion movably supporting the massaging member and that makes the massaging member perform a relative motion relative to the stationary portion repeatedly such that the massaging member describes in space a reference locus which is a predetermined closed curve for a kneading massage; an ascent-descent mechanism that adjustably moves up and down the position of the massaging member along the backrest portion together with the entire drive mechanism portion; and a controller that is configured to control the operation of the drive mechanism portion and the ascent-descent mechanism. The controller is configured to control the drive mechanism portion to make the massaging member perform a relative reciprocating movement relative to the stationary portion within a partial movement range corresponding to a partial segment of the reference locus. The controller is configured also to control the ascent-descent mechanism to make the massaging member and the drive mechanism portion perform an up-down movement in coordination with the relative reciprocating movement of the massaging member such that the movement produced by the drive mechanism portion and the movement produced by the ascent-descent mechanism are combined together to produce an actual motion of the massaging member so as to describe a locus which is a curve different from the reference locus.

BRIEF DESCRIPTION OF THE DRAWINGS

The significance and benefits of the present invention will become clear through the following description of some embodiments of it. It should however be understood that the embodiments described below are merely examples of how the present invention can be carried out, and therefore that the meanings of the terms used there to refer to the elements and features of the present invention are not limited to those in which they are used in the following description.

DETAILED DESCRIPTION OF PREFERRED EMBODIMENTS

First Embodiment of the Present Invention

Hereinafter, a massage machine according to a first embodiment of the present invention will be described with reference to FIGS. 1 to 12. This embodiment deals with what is called a chair-type massage machine, that is, a massage machine that administers a massage to a user while supporting the user seated in it.

Figure 1:
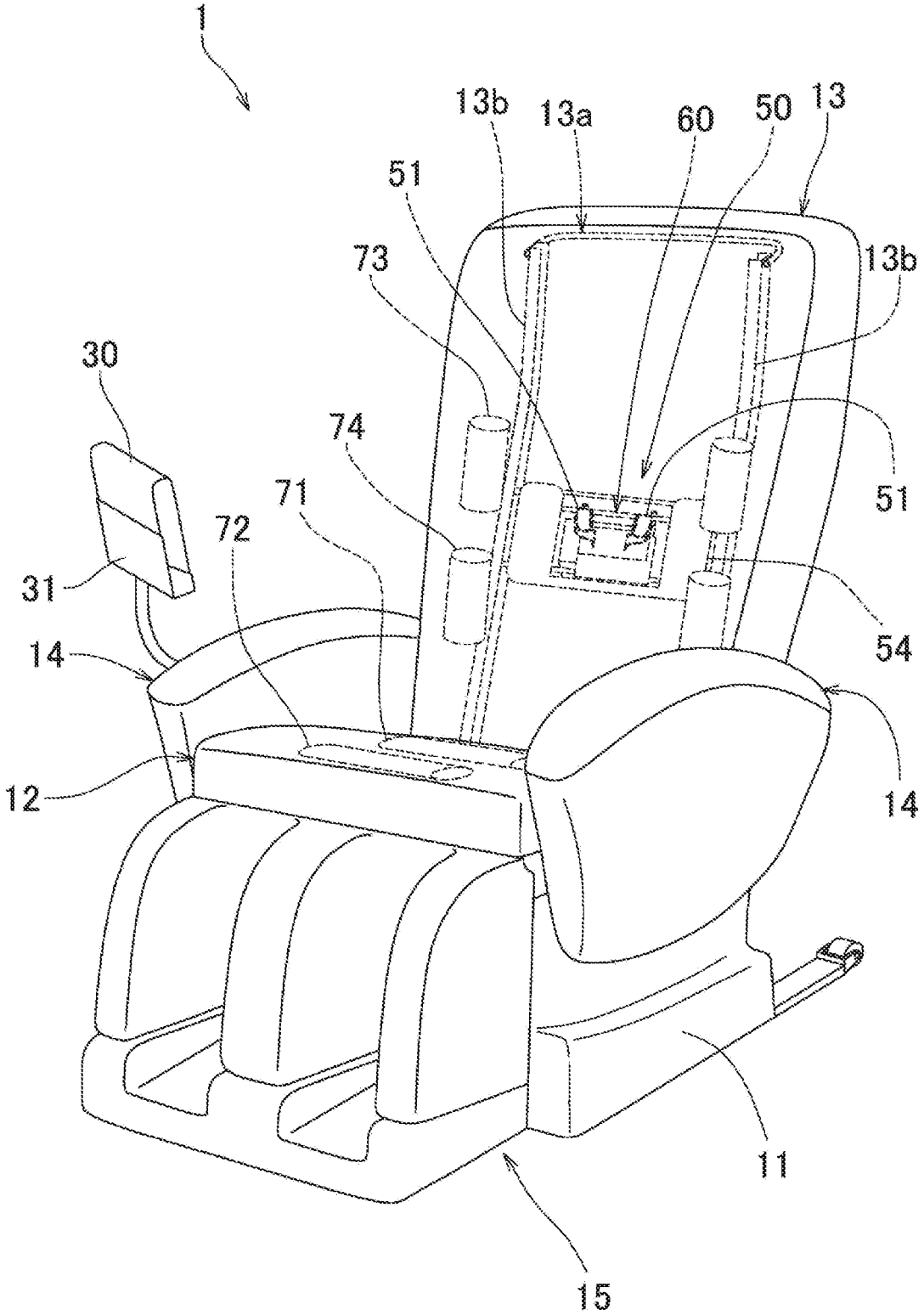
FIG. 1 is a perspective view of a massage machine according to a first embodiment of the present invention.
Figure 2:
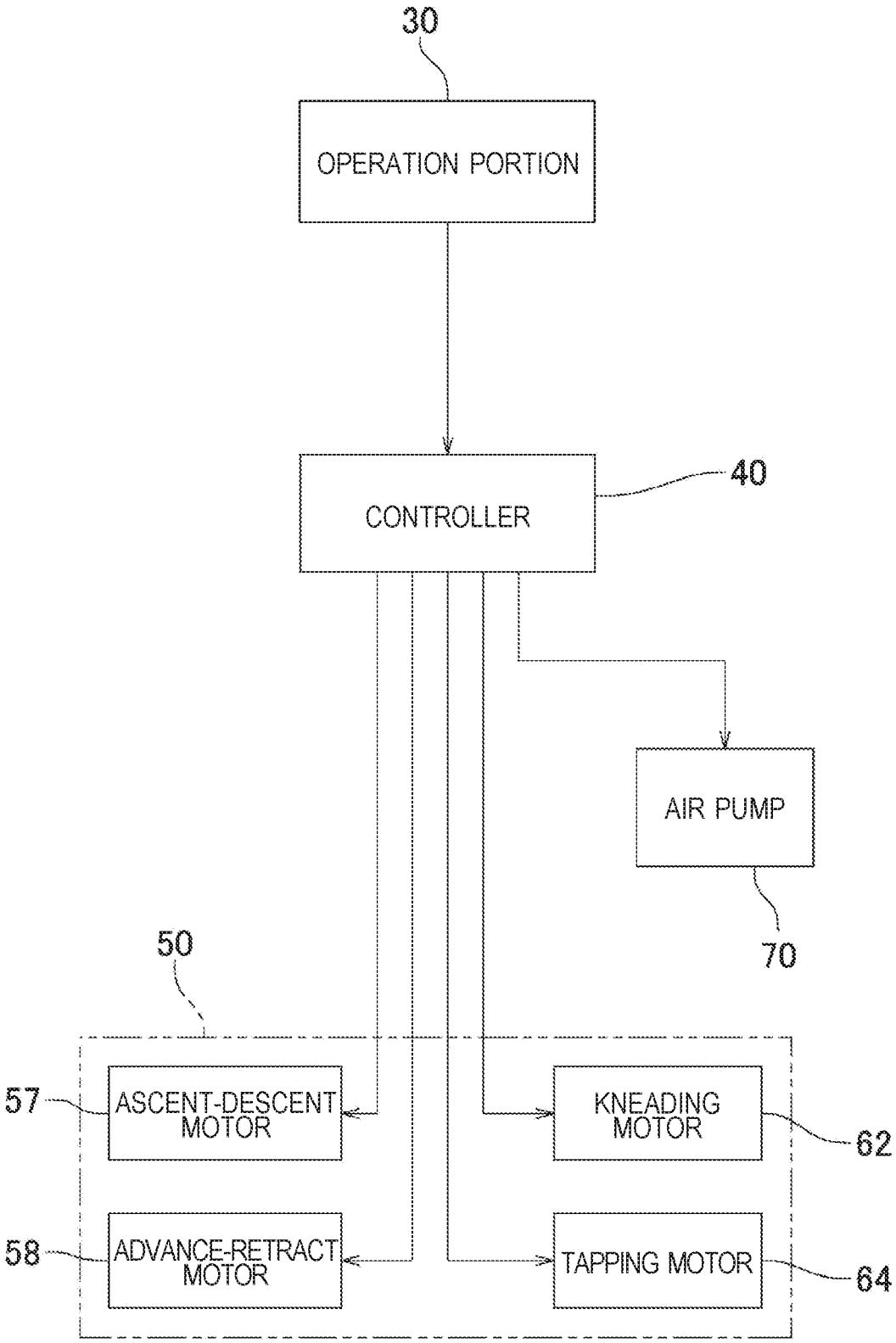
FIG. 2 is a block diagram of the massage machine according to the first embodiment of the present invention.
Figure 3:
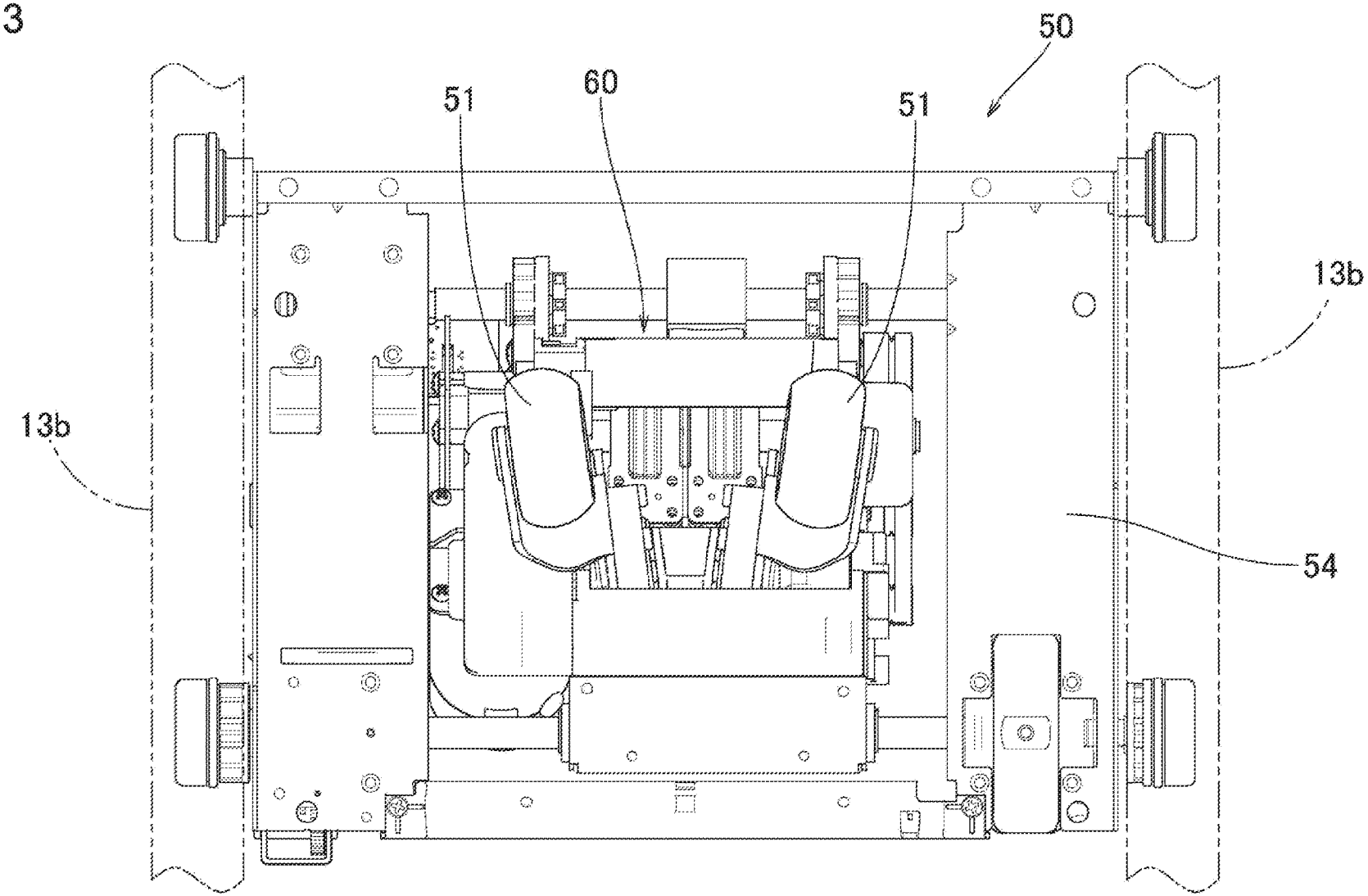
FIG. 3 is a front view of a mechanical unit in the massage machine according to the first embodiment of the present invention.
Figure 4:
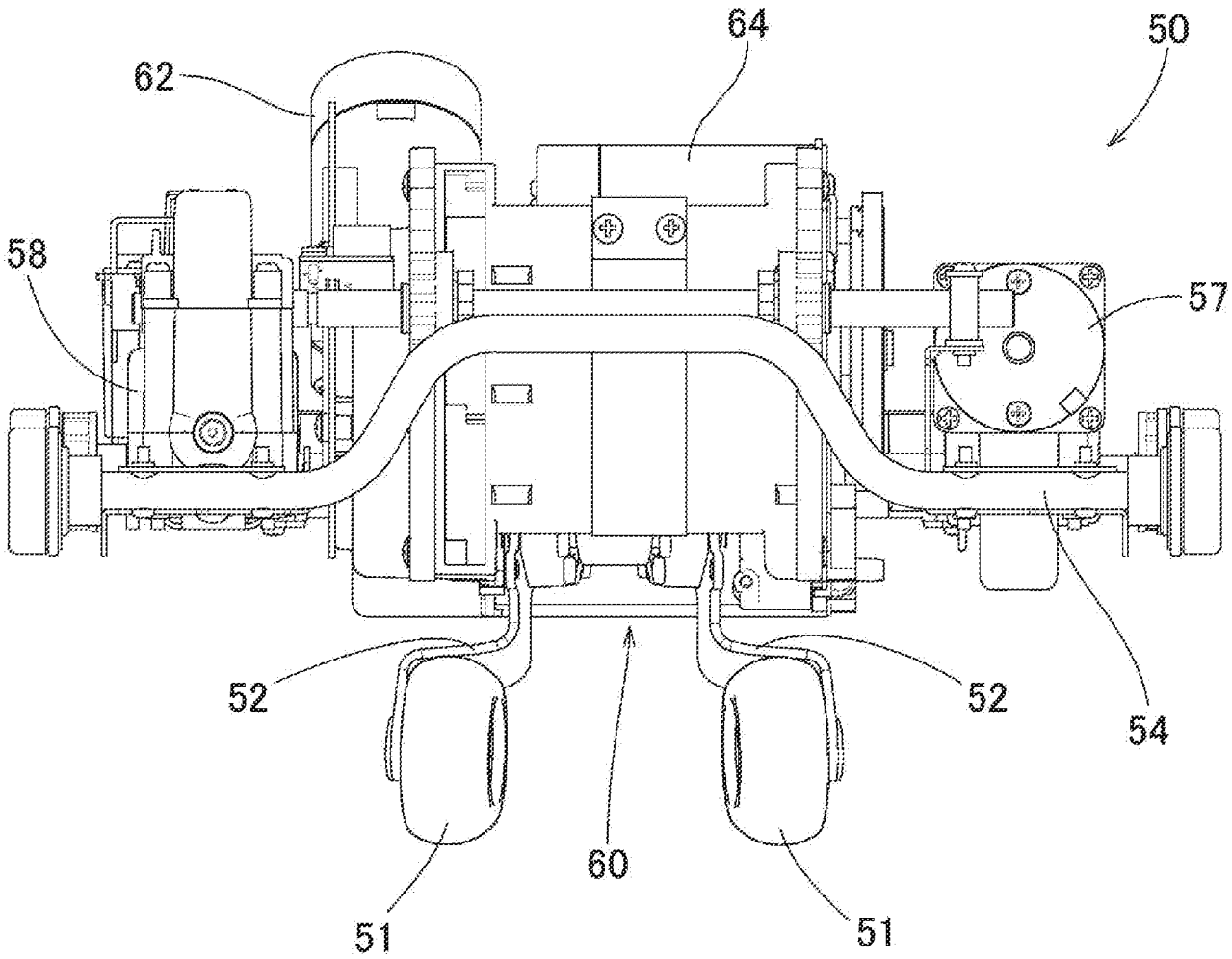
FIG. 4 is a plan view of the mechanical unit in the massage machine according to the first embodiment of the present invention.
Figure 5:
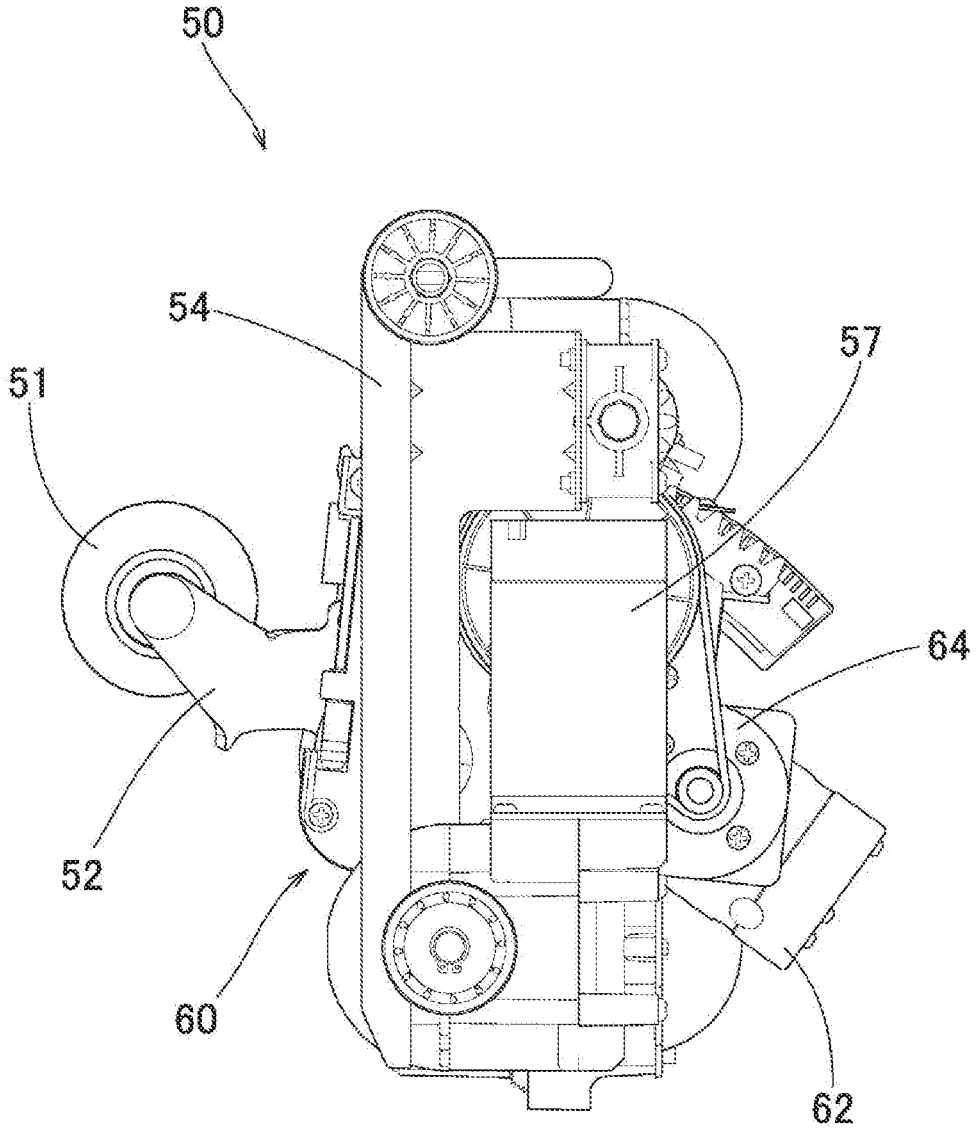
FIG. 5 is a right side view of the mechanical unit in the massage machine according to the first embodiment of the present invention.
Figure 6:
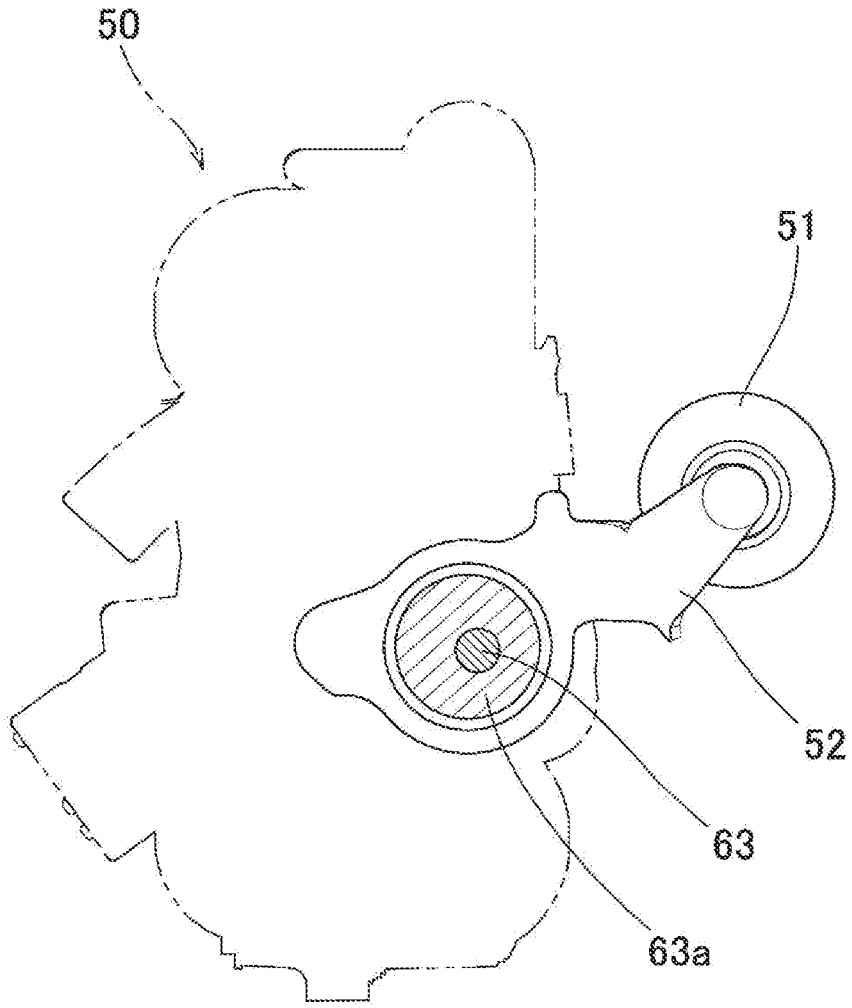
FIG. 6 is a schematic illustrative diagram of a kneading mechanism in the mechanical unit in the massage machine according to the first embodiment of the present invention.

As shown in FIG. 1, the massage machine 1 according to this embodiment includes: a pedestal portion 11 which is placed on a floor and which supports the entire chair stably; a seat portion 12 which supports the user's buttocks over the pedestal portion 11; a backrest portion 13 which supports the user's back at the back of the seat portion 12; armrest portions 14 which support the user's elbows and forearms at both, that is, right and left, sides of the seat portion 12; a leg support portion 15 which supports the user's legs at the front of the seat portion 12; an operation portion 30 which accepts the input of various operations by the user in connection with massages; and a controller 40 which controls the operating status of a plurality of massage mechanisms incorporated.

The pedestal portion 11 is integrally fitted with the different portions constituting the chair, namely the seat portion 12, the backrest portion 13, the armrest portions 14, and the leg support portion 15, and supports these. The seat portion 12 is so fitted that the inclination angle of the seat surface relative to the pedestal portion 11 is adjustable, and administers a massage by the action of an incorporated massage mechanism while supporting the user's buttocks and thighs on the seat surface. The massage mechanism in the seat portion 12 includes a buttock air cell 71 and a thigh air cell 72, both operating by supply and discharge of air. An air pump 70 which makes those air cells operate by supply and discharge of air is disposed in a space under the seat portion 12.

The backrest portion 13 is given a surface shape that fits the shape of the human back, and is so disposed that its inclination angle relative to the pedestal portion 11 and the seat portion 12 is adjustable. The backrest portion 13 includes inside it a massage mechanism that performs a massage.

Inside the backrest portion 13 are disposed: a mechanical unit 50 which has integrated in it a pair of, namely left and right, massaging members 51 and a drive mechanism portion 60 which makes them operate; a backrest frame 13*a*, in a frame form, which supports different parts of the backrest portion from inside while supporting the mechanical unit 50 such that this is movable up and down along the backrest portion 13; and a back air cell 73 and a waist air cell 74 which operate by supply and discharge of air by the air pump 70. Of these, the mechanical unit 50, the back air cell 73, and the waist air cell 74 each constitute a massage mechanism that performs a massage.

On both, namely left and right, side parts of the backrest portion 13, a pair of side wall portions may be disposed so as to protrude from them, the side wall portions being, on their inner sides facing the user, provided with massage mechanisms such as air cells so that a massage can be administered to the user's upper arms and the like from the side.

The backrest frame 13*a* has a frame structure substantially in the form of a ladder. This substantially ladder-form frame structure includes: a pair of, namely left and right, guide frames 13*b* which supports the mechanical unit 50 while permitting it to move up and down along the backrest portion 13 but preventing it from moving in other directions; and a plurality of horizontal frames which are laid laterally between and coupled to the guide frames 13*b*.

The mechanical unit 50 includes: a pair of, namely left and right, massaging members 51 which administers to the user a stimulus such as kneading and tapping; a pair of, namely left and right, massaging member support arms 52 which supports the massaging members 51 each in a protruding state; a drive mechanism portion 60 which via the massaging member support arms 52 makes the massaging members 51 move in ways corresponding to massages such as kneading and tapping; and a base portion 54 which supports the drive mechanism portion 60 such that this is inclinable about an axis perpendicular to the up-down axis of the backrest portion.

The drive mechanism portion 60 includes: a kneading motor 62 which generates a drive force for making the massaging members 51 perform a kneading massage under the control of the controller 40; a tapping motor 64 which generates a drive force for making the massaging members 51 perform a tapping massage under the control of the controller 40; and a kneading mechanism and a tapping mechanism (neither illustrated) which convert the rotating motion of those motors into motion corresponding to kneading and tapping, respectively, and which then transmit that motion via the massaging member support arms 52 to the massaging members 51. The drive mechanism portion 60 is a mechanism similar to those used in well-known massaging machines.

The kneading mechanism includes: a kneading shaft 63 which is rotatably supported inside the drive mechanism portion 60 and which is driven to rotate by the kneading motor 62; and massaging member support arms 52 which are fitted to, pivotably relative to, eccentric rotor portions 63*a* formed on the kneading shaft 63. The kneading shaft 63 supports via the massaging member support arm 52 the massaging members 51 such that these are movable.

In this kneading mechanism, as the kneading shaft 63 rotates by being driven by the kneading motor 62, the eccentric rotor portions 63*a*, which are disposed obliquely on the kneading shaft 63, rotate eccentrically relative to the shaft. Then the massaging member support arms 52, because these are fitted around the eccentric rotor portions 63*a* respectively and have their movement restricted due to their being coupled to the tapping mechanism, vibrate continuously as the eccentric rotor portions 63*a* rotate.

Figure 7:
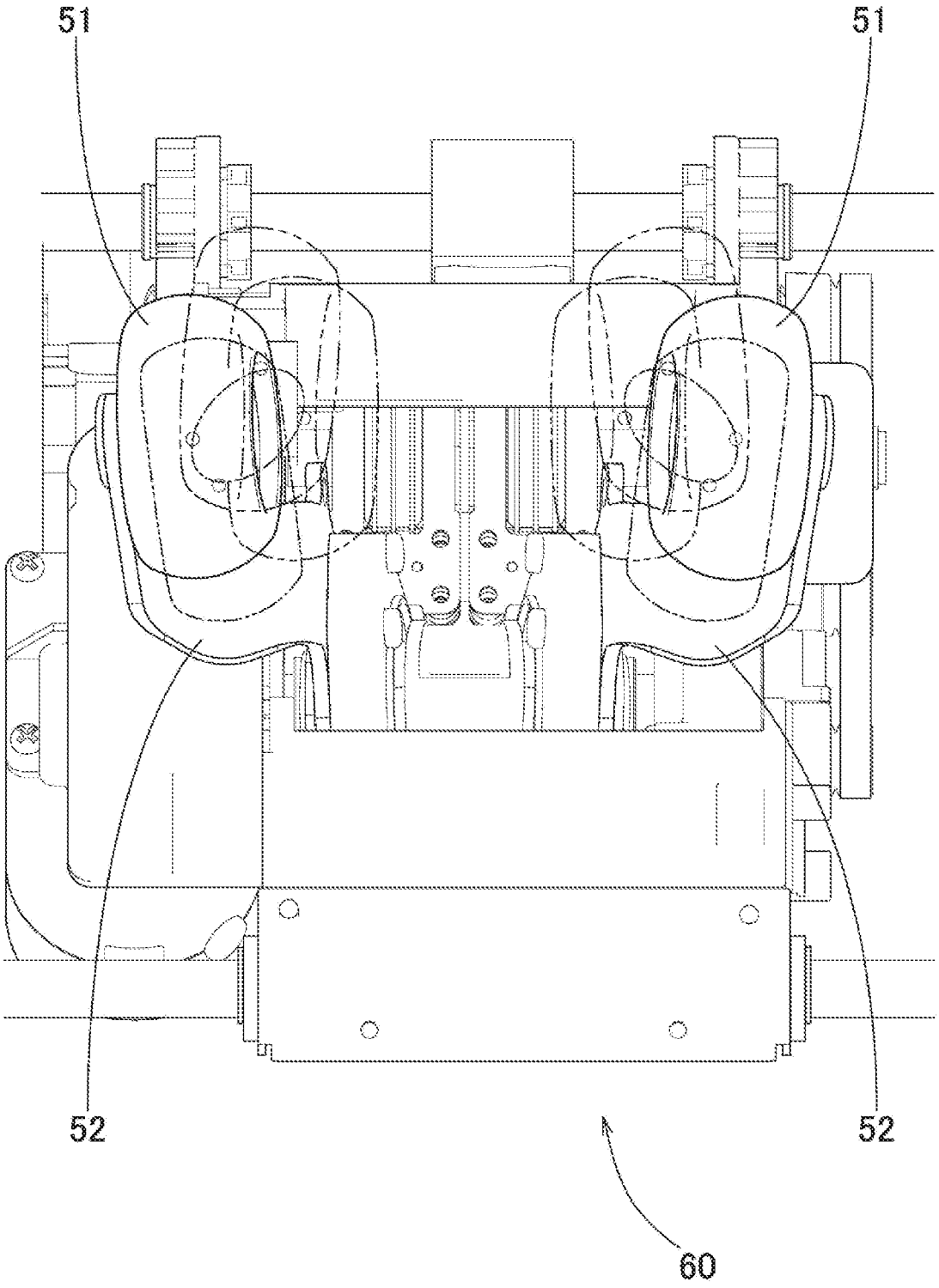
FIG. 7 is a schematic front view showing the movement of massaging members during a kneading massage on the massage machine according to the first embodiment of the present invention.
Figure 8:
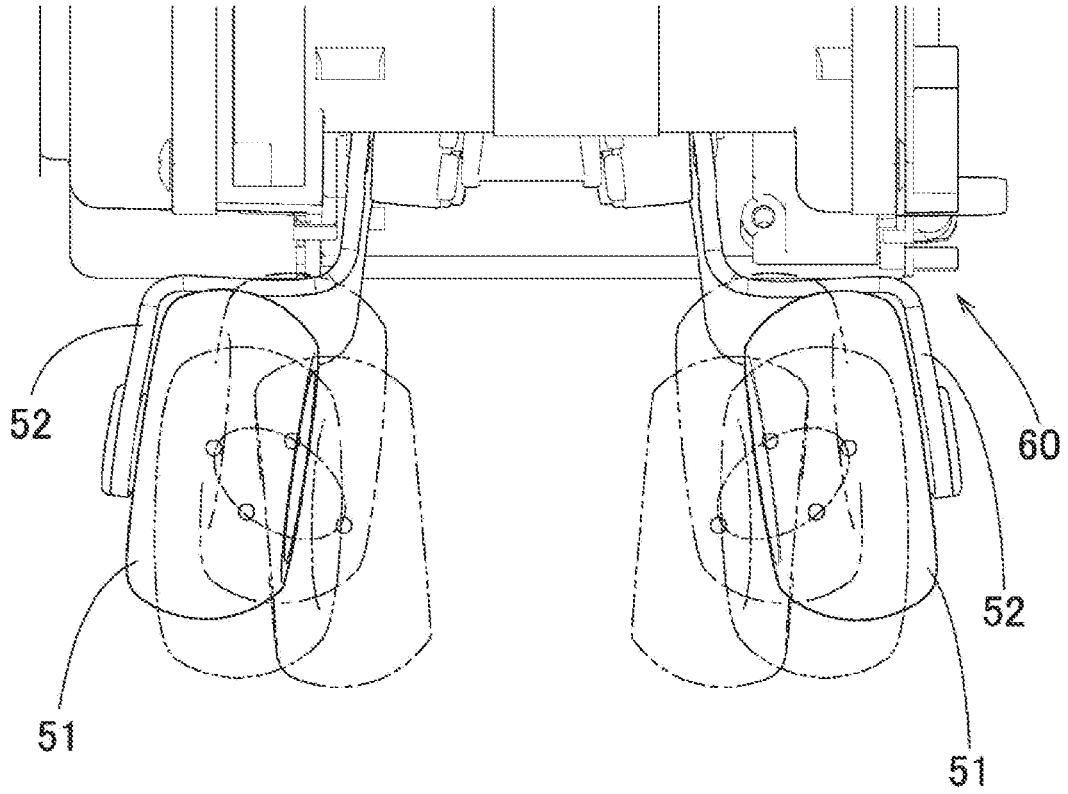
FIG. 8 is a schematic plan view showing the movement of the massaging members during a kneading massage on the massage machine according to the first embodiment of the present invention.
Figure 9:
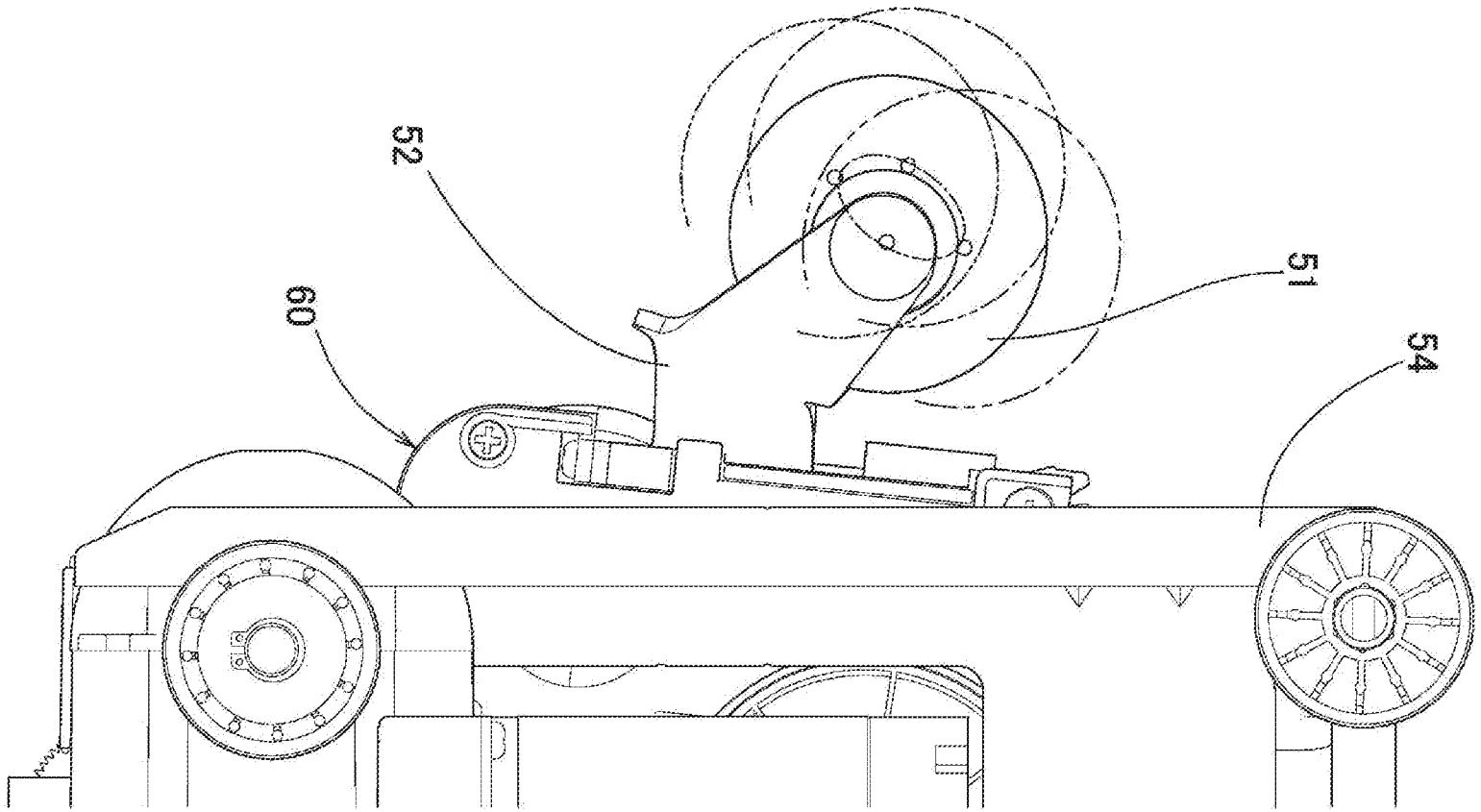
FIG. 9 is a schematic side view showing the movement of massaging members during a kneading massage on the massage machine according to the first embodiment of the present invention.

This mechanism achieves operation in which the massaging members 51 fitted to one-end parts of the massaging member support arms 52 move continuously along up-down, left-right, and front-rear axes relative to non-moving parts (a stationary portion) such as the kneading shaft 63 in the drive mechanism portion 60 so as to describe a previously defined closed curve, specifically a locus (reference locus) substantially in an elliptic shape (see FIGS. 7, 8, and 9). Thus, it is possible to achieve a kneading massage by operating the kneading motor 62 with the drive mechanism portion 60 held on the stationary portion appropriately so as not to produce a movement that may cancel the relative movement of the massaging members 51 and operating the massaging members 51 brought close to the user leaning on the backrest portion 13.

On the other hand, in the tapping mechanism, the tapping motor 64 is so rotated that the massaging member support arms 52 swing about a predetermined position. As the massaging member support arms 52 swing, also the massaging members 51, which are disposed at one-end parts of the arms, swing (reciprocate). This mechanism achieves a tapping massage.

The base portion 54 supports the drive mechanism portion 60 such that this is inclinable. The base portion 54 includes: an ascent-descent motor 57 which generates a drive force for making the mechanical unit ascend and descend under the control of the controller 40; and a advance-retract motor 58 which generates a drive force for making the drive mechanism portion 60 incline under the control of the controller 40.

The mechanical unit 50 is supported on, slidably up and down along, the pair of guide frames 13*b* in side-end parts of the base portion 54, which together with the ascent-descent motor 57 constitutes an ascent-descent mechanism. The mechanical unit 50 is thus arranged in a state held between the guide frames 13*b* so as to be as a whole movable along the guide frames 13*b*. When under the control of the controller 40 the ascent-descent motor 57 operates to make the base portion 54 slide along the guide frames 13*b*, the entire mechanical unit 50 including the base portion 54 and the drive mechanism portion 60 moves along the guide frames 13*b*, up and down along the backrest portion 13. This mechanism permits adjustment of the position of the massaging members 51 (the target area of a massage with the massaging members) along the up-down axis of the backrest portion 13.

According to the set type of massage, under the control of the controller 40, the mechanical unit 50 moves up and down along the backrest portion 13 as described above, and thereby adjusts the up-down position of the massaging members 51. According to the set type of massage, under the control of the controller 40, the mechanical unit 50 makes the advance-retract motor 58 operate to incline the massaging members 51 and the drive mechanism portion 60, and thereby adjusts the amount of protrusion of the massaging members 51 toward the user.

When a kneading or tapping massage is performed, after the massaging members 51 are moved to the massage target area and their position is adjusted as described above, or concurrently with such moving of the massaging members 51, the controller 40 makes the kneading and tapping motors in the drive mechanism portion 60 in the mechanical unit 50 according to the type of massage, and thereby makes the massaging members 51 administer a motion corresponding the set type of massage such as kneading or tapping.

The armrest portions 14 are disposed on opposite sides of the seat portion 12. The armrest portions 14 are configured to stably support the user's forearms even when the reclining angle of the backrest portion 13 is changed or the seat portion 12 is inclined. The armrest portions 14 may be furnished with air cells that operate by supply and discharge of air by the air pump 70 so that a massage can be administered to the user's hands and forearms.

The leg support portion 15 is located at the front of the seat portion 12, and is so disposed as to be inclinable about an axis near the front edge of the seat portion 12. Also the leg support portion 15 may be furnished with massaging means such as air cells for legs that operate by supply and discharge of air by the air pump 70 or rollers that press the legs while moving up and down.

The operation portion 30 is provided with a number of switches and a display that accept the input of various operations to the massage machine. The operation portion 30 is detachably attached to a stand 31 at the side of the massage machine 1, and transmits the input operations to the controller 40. The position of the stand 31 is adjustable so that the switches and the display on the operation portion 30 can be placed optimally with respect to the user.

The controller 40 adjusts the massage mechanisms and other movable parts of the massage machine into a condition that suits the user on the basis of detection results that are obtained previously by detecting the positions of different parts of the user's body. The controller 40 controls the massage mechanisms and other movable parts to perform an appropriate massage on the basis of operations on the operation portion 30, the previously recorded and set type of massage, and information on the detection results mentioned above.

In terms of hardware, the controller 40 is a computer that includes a CPU, memory, an input/output interface, and the like. The computer operates as the controller 40 by executing programs stored on the memory or the like. The computer constituting the controller 40 may be a microcomputer that has a CPU, memory, ROM, and the like integrated together.

A unit of the computer that constitutes the controller 40 is disposed in a predetermined space inside the massage machine 1, such as right under the seat portion 12. The controller 40 can communicate with the operation portion 30. The controller 40 is electrically connected to each of the different motors in the mechanical unit 50, the actuators that make the seat portion 12, the backrest portion 13, and the leg support portion 15 incline, and the air pump 70. The controller 40 controls the operation of those driving mechanisms by outputting control signals according to, during detection of the positions of parts of the user's body, a previously set position detection program and, during administration of a massage, data on the set type of massage.

In addition, the controller 40 is electrically connected also to signal outputting means, such as encoders, that output the amounts of displacement of different parts of and different actuators in the mechanical unit 50. The controller 40 controls the operation of driving means such as motors and actuators while monitoring the status of different parts of the mechanical unit 50, such as the rotation angle of the kneading shaft 63, and the status, such as the inclination, of the seat portion 12, the backrest portion 13, and the leg support portion 15.

In accordance with what the user selects and requests on the operation portion 30, specifically a basic massage function or a massage course comprising a plurality of massage functions arranged so as to be performable in a predetermined order, the controller 40 reads, based on instruction data from the operation portion 30, the data on the massage function or course selected by the user from a storage portion in the controller 40. The controller 40 outputs control signals based on the read data, and makes the different massage mechanisms, specifically the mechanical unit 50 and/or the air pump 70, operate so that, through mechanical massaging by the massaging members 51 of the mechanical unit 50 and/or through air-cell massaging, the massage corresponding to the massage function or course selected by the user is administered to the user.

Also, like well-known massage machines, during the detection of the positions of different parts of the user's body prior to a massage, the controller 40 controls the mechanical unit 50 to make it move along the guide frames 13*b* from its initial position in the backrest portion 13 so that the massaging members 51 move along the user; meanwhile the controller 40 continually acquires the variation of the pressure on the massaging members 51 from the user leaning on the backrest portion 13 and the variation of the inclination of the massaging members 51, and based on such information, the controller 40 can detect, with respect to the user, the position of the shoulders, the spinal line, and the position of the waist.

Also, the controller 40 previously grasps the relationship of different rotation angles (phases) of the kneading shaft 63 and the eccentric rotor portion 63*a* versus different positions of the massaging members 51 on the reference locus on a one-to-one basis. Thus, by acquiring the rotation angle of the kneading shaft 63 with an encoder or the like, the controller 40 can simultaneously recognize the position of the massaging members 51. Capable of recognizing the position of the massaging members 51 in this way, the controller 40 can control the operation of the kneading motor 62 so as to make the kneading shaft 63 rotate through a predetermined angle to place the massaging members 51 at a predetermined position on the reference locus or so as to allow the massaging members 51 to move only within a predetermined partial segment of the reference locus.

The controller 40 then controls the massaging members 51 so as to make them perform a relative reciprocating movement with respect to the stationary portion such as the kneading shaft 63 within a partial movement range corresponding to the partial segment of the reference locus. Concurrently with this control, the controller 40 controls the ascent-descent motor 57, which constitutes the ascent-descent mechanism, so that it makes the mechanical unit 50 including the massaging members 51 and the drive mechanism portion 60 perform a predetermined up-down movement. Concurrently making the massaging members 51 perform a relative reciprocating movement and making the mechanical unit 50 perform an up-down movement in this way results in the two motions being combined together to produce an actual motion that describes a locus (composite locus) which is a curve substantially in a circular or elliptic shape smaller than the reference locus. This mechanism achieves a massage with the massaging members 51 to a small area (for example, a massage corresponding to press-and-knead), that is, one different from an ordinary kneading massage based on repetition of a motion of the massaging members 51 describing the reference locus.

Figure 10:
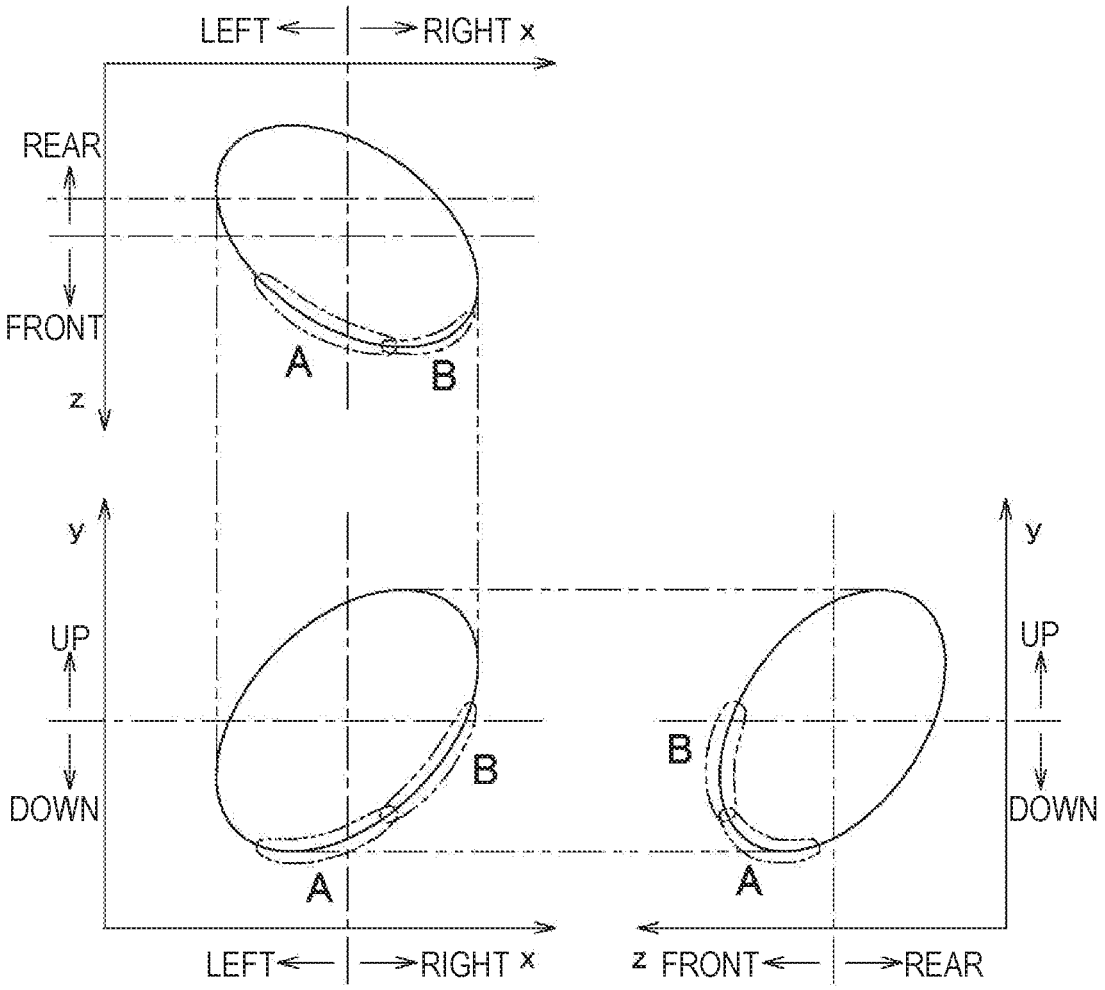
FIG. 10 is an illustrative diagram of a reference locus of the left massaging member on the massage machine according to the first embodiment of the present invention.

One example of the reference locus of the massaging members 51 obtained by rotating the kneading shaft 63 under the control of the controller 40 is shown in FIG. 10 (which only shows the locus of the left-hand massaging member as seen from in front of the user's body). This example of the reference locus describes a closed curve substantially in an elliptic shape inclined relative to all of xy-plane, xz-plane, and yz-plane in a three-dimensional space.

When producing an actual motion of the massaging members 51 that is smaller than the reference locus as described above, the controller 40 can use, as the partial movement range within which the kneading mechanism in the drive mechanism portion 60 makes the massaging members 51 perform a relative reciprocating movement, for example, a predetermined partial segment (for example, a partial segment A or B in FIG. 10) of the reference locus shown in FIG. 10 of which the front-rear position on the locus is frontward and close to the user. In this example, even without front-rear position adjustment of the massaging members 51 involving inclining the massaging members 51 together with the entire drive mechanism portion 60, it is possible to obtain a state where the massaging members 51 are brought close to the user. In addition, it is possible, while maintaining the state where the massaging members 51 are located close to the user, to perform a massage and administer a sufficient stimulus without much moving the massaging members 51 along the front-rear axis.

By performing control for appropriate adjustment of the setting of the range of left-right movement by the drive mechanism portion 60 and the setting of the range of ascending and descending movement, the controller 40 can set a plurality of curves with different sizes as composite loci (loci of the actual motion) resulting from combination of the movement of the massaging members 51 by the drive mechanism portion 60 with their movement by the ascent-descent mechanism, and can move the massaging members 51 so as to describe one, with a particular size, of those composite loci. It is then possible to easily change the target area of a massage by the massaging members 51, and to administer the massage to an appropriate area that suits the situation. For example, in a case where the massaging members 51 are moved with such settings as to describe a composite locus of a size corresponding to the thumb, the bulb of the thumb, or the wrist of a human, it is possible to perform a massage comparable with a press-and-knead massage performed by a human, and it is thus possible to perform a massage efficiently with an adequate pressure applied to a limited target area as a human can by hand, leading to an enhanced massage effect.

Next, a description will be given of how a massage describing a composite locus as described above is performed with the massaging members 51 on the massage machine according to this embodiment. It is assumed that the following has been gone through: with the user seated on the massage machine 1 with his or her back leaning on the backrest portion 13, the main power to the massage machine 1 is turned on; the massage machine 1 thus starts up and completes preparatory operation before the start of a massage, such as detection of the user's physical build and adjustment of the inclination angle of the backrest portion 13; the user enters an instruction for desired operation, such as a massage course; the controller 40 then performs massages according to the massage course, and is now about to administer, as one of those massages, a massage involving a motion of the massaging members 51 describing a composite locus to a massage target area on the user's body.

Figure 11:
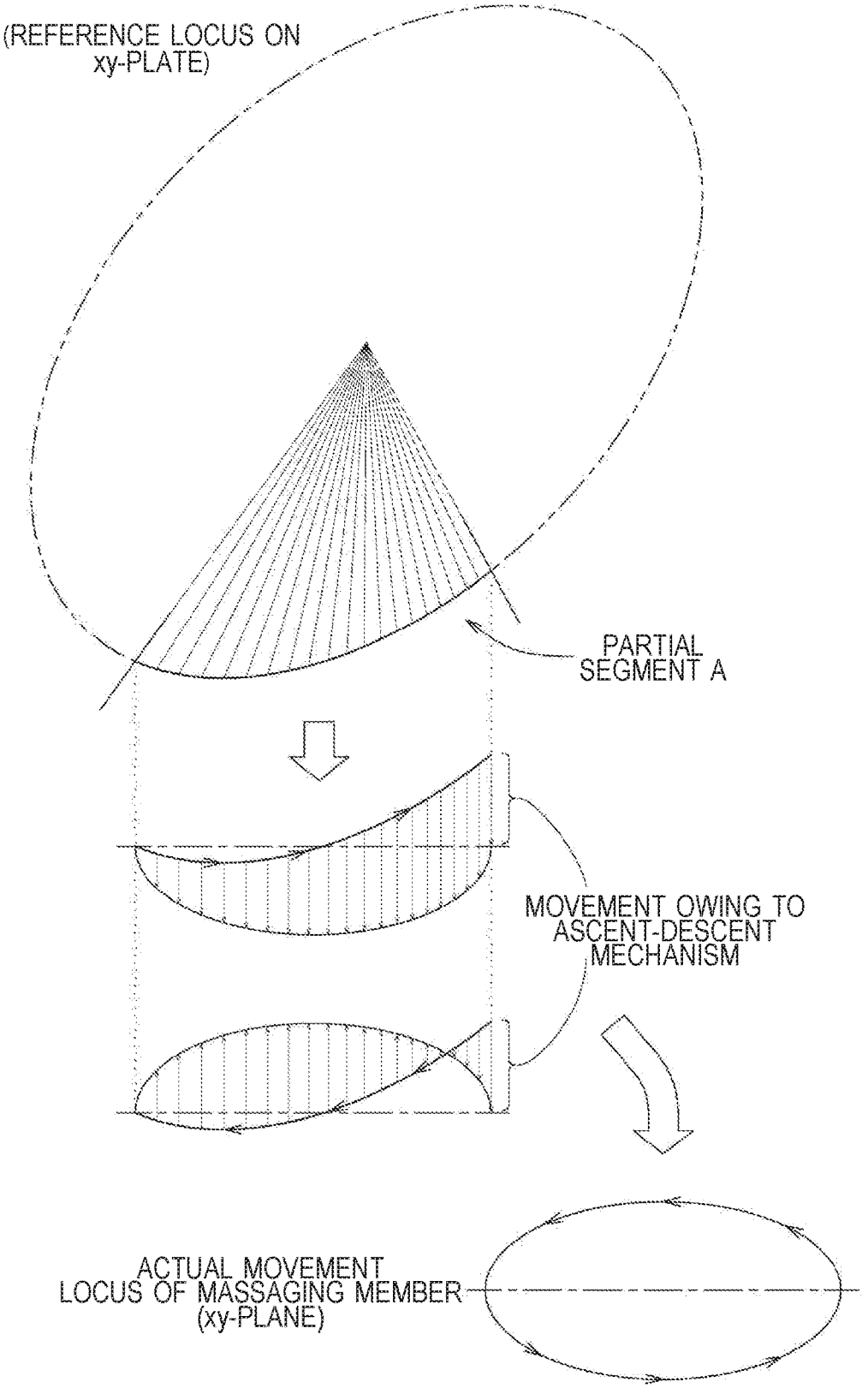
FIG. 11 is an illustrative diagram of a composite locus resulting from combination based on a partial segment of the reference locus on the massage machine according to the first embodiment of the present invention.

It is also assumed that, for the purpose of performing a massage with a motion of the massaging members 51 describing a composite locus, as the partial movement range within which to make the massaging members 51 perform a relative reciprocating movement to produce the composite locus corresponding to the massage, a predetermined partial segment A frontward on the reference locus of the massaging members 51 is previously set (see FIGS. 10 and 11).

To perform the massage, according to settings made as to the massage target area and the like, the controller 40 first makes, by the action of the ascent-descent motor 57, the mechanical unit 50 move along the guide frames 13*b*, up and down along the backrest portion 13, and thereby adjusts the up-down position of the massaging members 51.

The controller 40 makes the kneading motor 62 in the drive mechanism portion 60 operate and, while acquiring the rotation angle of the kneading shaft 63 and calculating and grasping the position of the massaging members 51, moves the kneading shaft 63 so that the massaging members 51 are located at a massage start position in the partial movement range within which to make the massaging members 51 perform a relative reciprocating movement, that is, at a prescribed start position within the predetermined partial segment A of the reference locus set as the partial movement range (for example, at an end of the segment).

Also, the controller 40 makes the advance-retract motor 58 operate to incline the entire drive mechanism portion 60 including the massaging members 51, and adjusts the amount of protrusion of the massaging members 51 toward the user, thereby to place the massaging members 51 at the massage target area on the back of the user leaning on the backrest portion 13.

The controller 40 then starts to perform a massage, that is, it makes the kneading motor 62 in the drive mechanism portion 60 operate and, while acquiring the rotation angle of the kneading shaft 63 and calculating and grasping the position of the massaging members 51, makes the massaging members 51 start a motion that effects a massage. Specifically, to make the massaging members 51 reciprocate along the partial segment A of the reference locus, the controller 40 repeatedly performs control such that the kneading motor 62 makes the kneading shaft 63 rotate forward through a predetermined angle and then backward through the same predetermined angle.

Concurrently, the controller 40 makes the ascent-descent motor 57 as the ascent-descent mechanism operate so that it makes the massaging members 51 together with the entire mechanical unit 50 move up and down so as to give the massaging members 51 predetermined up-down displacements along the backrest portion 13 that are in phase with the movement of the massaging members 51 along the partial segment of the reference locus.

Figure 12:
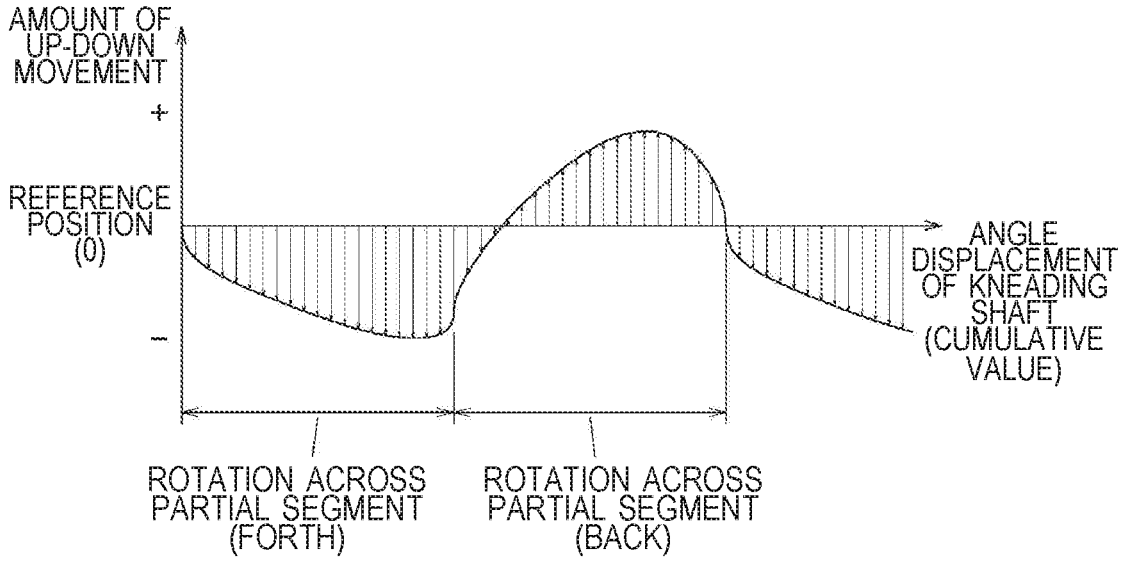
FIG. 12 is an illustrative diagram of variation of the amount of up-down movement of the mechanical unit in the massage machine according to the first embodiment of the present invention.

The up-down movement of the mechanical unit 50 here proceeds as shown in FIG. 12, that is, with reference to the displacement of the rotation angle of the kneading shaft 63, as follows: as the displacement (cumulative value) of the rotation angle of the kneading shaft 63 increases with time, the amount of up-down movement of the massaging members 51 together with the entire mechanical unit 50 repeats a predetermined amount of variation; that is, the amount of up-down movement of the massaging members 51 together with the entire mechanical unit 50 varies periodically.

Thus, when, with respect to the stationary portion, such as the kneading shaft 63, that remains stationary on the drive mechanism portion 60, the massaging members 51 is made to perform a relative reciprocating movement within a partial movement range corresponding to a partial segment of the reference locus and simultaneously the mechanical unit 50 including the massaging members 51 and the drive mechanism portion 60 is made to perform an up-down movement along the backrest portion 13, the motion of the massaging members 51 as seen from the user outside the massage machine is one that results from the two motions being combined together (see FIG. 11). The actual motion of the massaging members 51 resulting from such combination describes, relative to the user, for example as shown in FIG. 11, a locus (composite locus) that is a curve substantially in an elliptic shape smaller than the reference locus.

By making the massaging members 51 produce an actual motion that describes a composite locus different from the reference locus, it is possible to administer with the massaging members 51 a massage (for example, a massage corresponding to press-and-knead) to a small area, that is, a massage different from an ordinary kneading massage relying on repetition of a motion that describes the reference locus of the massaging members 51.

In particular, in a case where the controller 40 adjusts and controls adequately the range of left-right movement of the massaging members 51 (along x-axis in FIG. 10) and the amount of up-down movement of the massaging member 51 together with the entire mechanical unit 50 (along y-axis in FIG. 10) such that the composite locus which is a curve substantially in an elliptic shape has a size corresponding to the thumb, the bulb of the thumb, or the wrist of a human, the massaging members 51 move so as to describe a composite locus with a size comparable with that of a motion of the human hand and fingers. It is thus possible to perform a massage corresponding to one that a human performs by press-and-knead, and thus to efficiently perform a massage with an adequate pressure applied to a limited target area as a human can by hand.

The controller 40 uses, as the partial movement range within which to make the massaging members 51 perform a relative reciprocating movement, a predetermined partial segment of the reference locus of which the front-rear position (along z-axis in FIG. 10) on the locus is frontward and close to the user so that a motion effecting a massage is produced with the massaging members 51 protruding toward the user. Thus, it is possible, without front-rear position adjustment of the massaging members 51 involving their being moved together with the entire drive mechanism portion 60, to obtain a state where the massaging members 51 are brought close to the user and, while this state where the massaging members 51 are located close to the user is maintained, to perform a massage; it is thus possible to administer a massage with a substantially constant intensity of pressure to an area smaller than the target area of an ordinary kneading massage. In this way, it is possible, without front-rear position adjustment of the massaging members 51, to apply a sufficient stimulus with the massaging members 51 and to perform a comfortable massage reliably without strain with suppressed variation of the stimulus, applying the stimulus efficiently and adequately.

When a previously set period of time passes and the massage in which the massaging members 51 move so as to describe the composite locus is complete, unless the next massage can be performed with no change in the state of the mechanical unit 50 in the backrest portion 13, the controller 40 proceeds to the next massage in a massage course or stops the operation of the relevant portions to end the massage course, thereby finishing the series of processes related to massages.

As described above, in the massage machine according to this embodiment, with respect to the massaging members 51, which during an ordinary kneading massage to the user performs a relative motion so as to describe a reference locus, the controller 40 controls such that the massaging members 51 perform a relative reciprocating movement within a partial movement range corresponding to a partial segment of the reference locus and such that, in coordination with that, the ascent-descent mechanism makes the massaging members 51 and the drive mechanism portion 60 perform an up-down movement so that the relative reciprocating movement along the partial segment of the reference locus of the massaging members 51 and the up-down movement of the entire drive mechanism portion 60 are combined together to produce a motion of the massaging members 51 that effects a new massage in which the massaging members 51 describe a locus which is a curve different from the reference locus. This makes it possible to administer the motion of the massaging members 51 to a smaller area compared with an ordinary kneading massage and, as by applying a series of smaller kneading motions (press-and-knead) compared with an ordinary kneading massage, to apply a stimulus that an ordinary kneading massage does not offer, leading to an efficient massage. It is thus possible to further promote, with a massage, alleviation of stiffness and pain in muscles, fatigue reduction, and so forth, and also to increase the variety of massages, catering better to the user's preferences.

With the rotation of the kneading shaft 63, the massaging members 51 can be made to produce a motion so as to describe the reference locus, and also the relative reciprocating movement of the massaging members 51 within the range corresponding to the partial segment of the reference locus can be produced with the forward and backward rotation of the kneading shaft 63. Thus, through two channels of control by the controller 40, that is, the control of the rotation of the kneading shaft 63 and the control of the motion of the ascent-descent mechanism, the complex motion of the massaging members 51 can be produced. It is thus possible to obtain a simple and highly reliable massage mechanism.

In the massage machine according to the embodiment described thus far, the movement along the reference locus of the massaging members 51 by the operation of the drive mechanism portion 60 and the up-down movement of the massaging members 51 together with the entire mechanical unit 50 are combined together to make the massaging members 51 move substantially in an elliptic shape to administer a massage to a small massage target area on the user. This, however, is not meant as any limitation. Instead, for example, as in a predetermined ordinary massage administered to a large area on the body (back) by moving the mechanical unit 50 up and down continuously while moving with the drive mechanism portion 60 the massaging members 51 brought close to the user, it is possible to move the mechanical unit 50 up and down little by little with the very aim of moving it in a manner superposed on the up-down movement of the mechanical unit 50 for the sake of producing the combined motion of the massaging members 51 and, while performing a massage, to shift the target position up or down little by little so that eventually a massage different from an ordinary one is administered over a large area on the body along the up-down axis.

Second Embodiment of the Present Invention

In the massage machine according to the first embodiment, the controller 40 uses, as the partial movement range within which the kneading mechanism in the drive mechanism portion 60 makes the massaging members 51 perform a relative reciprocating movement, a predetermined partial segment of the reference locus of which the front-rear position on the locus is frontward and close to the user. Specifically, the controller 40 uses a partial segment A of the reference locus frontward along the front-rear axis (along z-axis in FIG. 10) on the locus and in addition distal with respect to the body (in the case of the reference locus shown in FIG. 10, downward on xy-plane) to increase the amount of left-right movement of the massaging members 51 in relative terms. This, however, is not meant as any limitation. Instead, for example, as a second embodiment, as shown in FIGS. 13 and 14, the controller 40 can take any other segment of the reference locus as the partial movement range within which to make the massaging members 51 perform the relative reciprocating movement.

Figure 13:
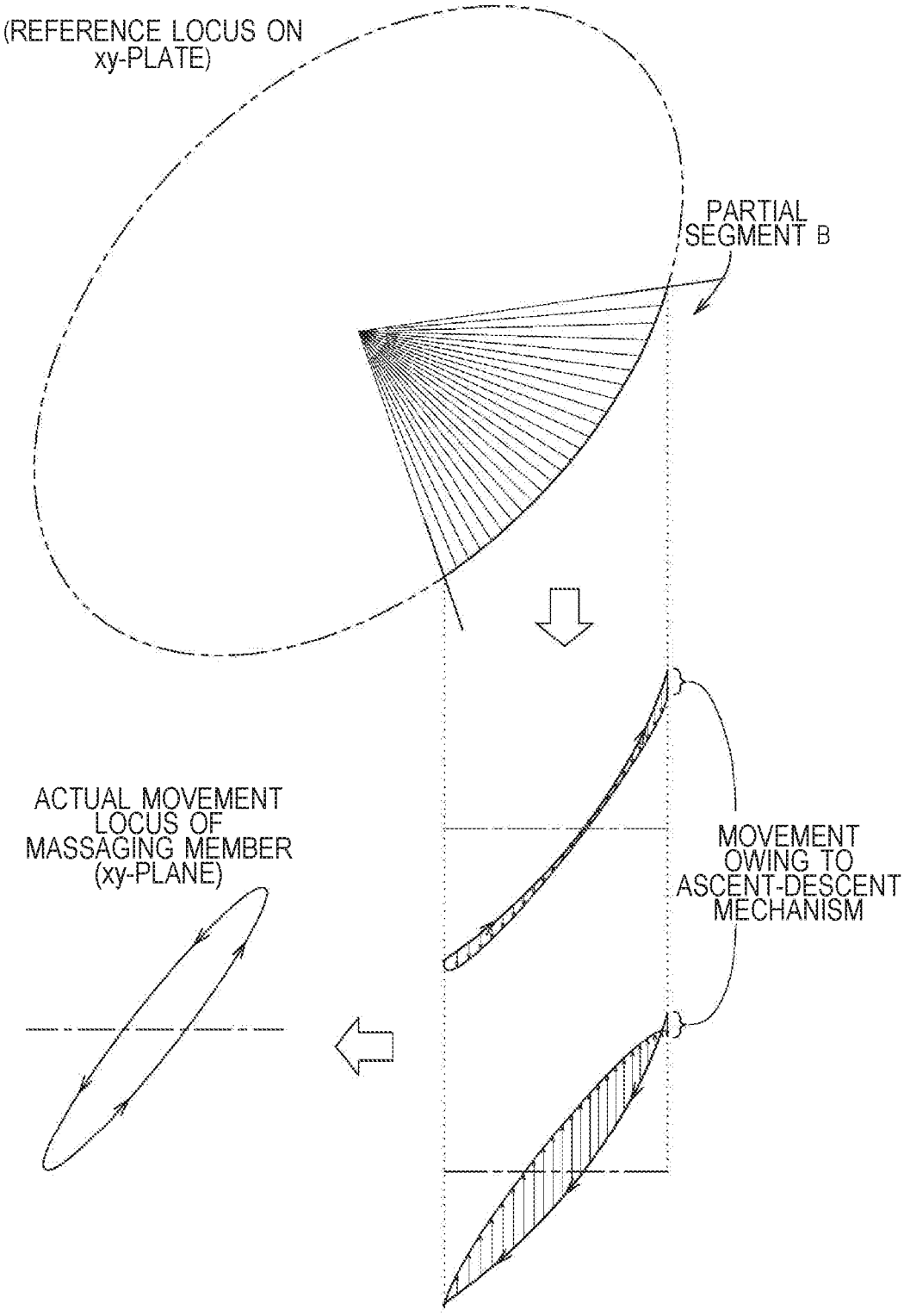
FIG. 13 is an illustrative diagram of a composite locus resulting from combination based on a partial segment of the reference locus on a massage machine according to a second embodiment of the present invention.
Figure 14:
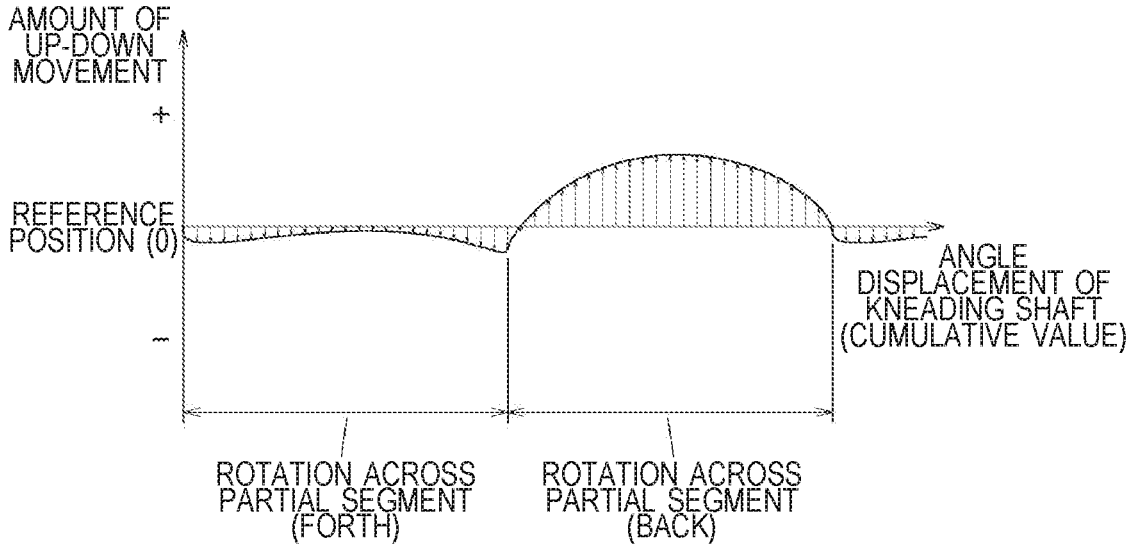
FIG. 14 is an illustrative diagram of variation of the amount of up-down movement of the mechanical unit in the massage machine according to the second embodiment of the present invention.

As a specific example, as shown in FIGS. 10 and 13, the controller 40 can set the movement range so as to use another partial segment of the reference locus of which the front-rear position on the locus is frontward, more specifically a partial segment B of the reference locus frontward along the front-rear axis (along z-axis FIG. 10) on the locus and proximal with respect to the body (in the case of the reference locus shown in FIG. 10, rightward on xy-plane).

Even in that case, by performing a motion that effects a massage with the massaging members 51 protruding toward the user, it is possible, without front-rear position adjustment of the massaging members 51 involving their being moved together with the entire drive mechanism portion 60, to obtain a state where the massaging members 51 are brought close to the user. Moreover, by using a segment in which left-right and up-down motions of the massaging members 51 take place concurrently without direction switching, it is possible to secure a sufficient amount of, in particular, up-down movement of the massaging members 51 (see FIG. 13). Then a large part of the amount of up-down movement of the massaging members 51 during their actual movement can be accounted for by the movement of the massaging members 51 themselves. It is thus possible to reduce the amount of up-down movement of the entire mechanical unit 50 achieved by the operation of the ascent-descent motor 57 as the ascent-descent mechanism (see FIG. 14), to reduce the frequency of the operation of the mechanical unit 50 involved in up-down movement, and to reduce the burden on the ascent-descent mechanism such as the ascent-descent motor 57. Further, it is possible to make the motion of the massaging members 51 so much smoother as the actual movement of the massaging members 51 is more similar to the relative movement of the massaging members 51 themselves along the reference locus of the massaging members 51, and to perform a massage comparable with an ordinary kneading massage with the massaging members 51.

Third Embodiment of the Present Invention

Figure 15:
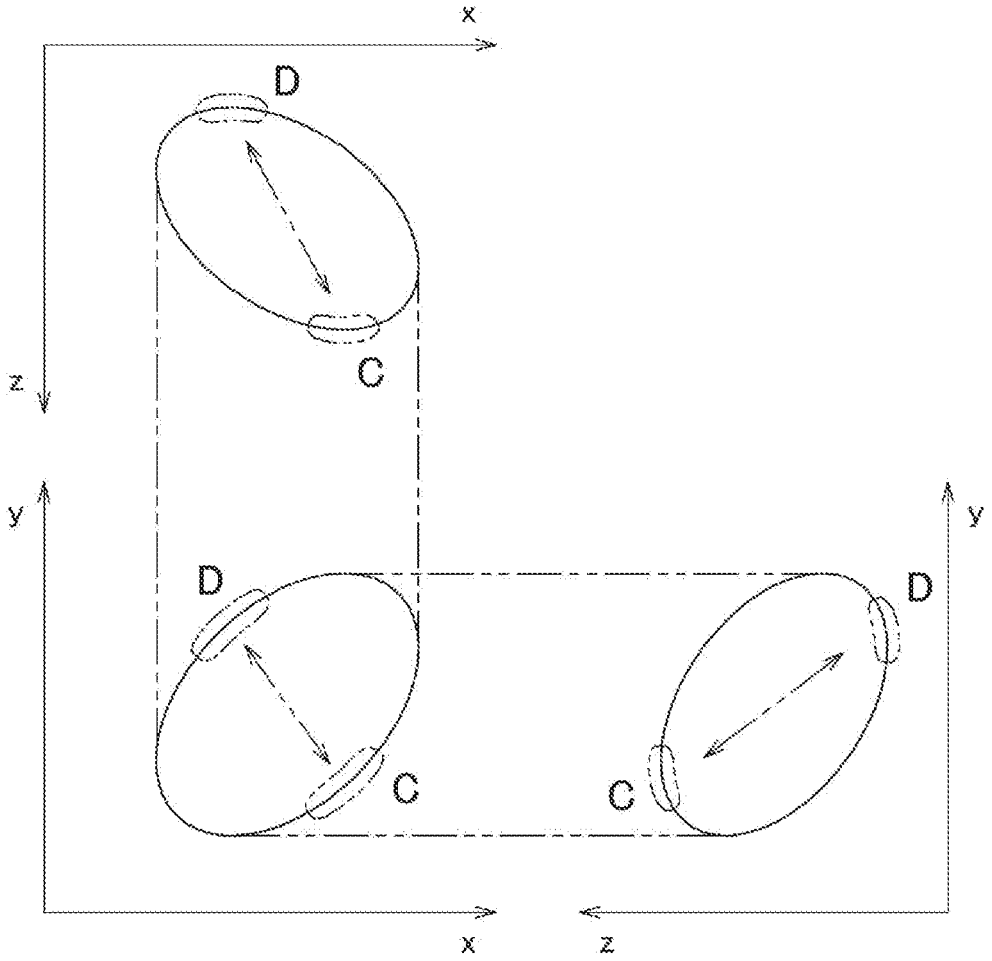
FIG. 15 is an illustrative diagram of a reference locus of the left massaging member, and switching of partial segments of it, on a massage machine according to a third embodiment of the present invention.

In the massage machine according to the first embodiment, the controller 40 chiefly uses, as the partial movement range within which the kneading mechanism in the drive mechanism portion 60 makes the massaging members 51 perform a relative reciprocating movement, a partial segment of the reference locus of which the front-rear position on the locus is frontward and close to the user. This, however, is not meant as any limitation. Instead, for example, as a third embodiment, as shown in FIG. 15, a configuration is also possible in which the controller 40 can switch between states where it selects, as the movement range within which the drive mechanism portion 60 makes the massaging members 51 perform the relative reciprocating movement, a predetermined partial segment of the reference locus including the frontmost position closest to the user and a predetermined partial segment of the reference locus including the rearmost position farthest from the user respectively.

In that case, as the partial movement range of the massaging members 51, switchable selection can be allowed between, of the reference locus, a frontward partial segment C close to the user and a rearward partial segment D far from the user (see FIG. 15) so that a plurality of positions at which the massaging members 51 perform a massage can be set along the front-rear axis. In this way, it is possible, without generally practiced front-rear position adjustment of the massaging members involving their being moved together with the entire drive mechanism portion 60, to switch positions of the massaging members simply by setting segments on the reference locus that are used as the range for relative movement of the massaging members 51. It is thus possible to easily change the intensity of a massage administered to an area smaller than the target area of an ordinary kneading massage, and thus to easily perform a massage with an adequate intensity adjusted to suit the situation without requiring operation of a plurality of mechanisms involved in position adjustment of the massaging members 51.

Figure 16A:
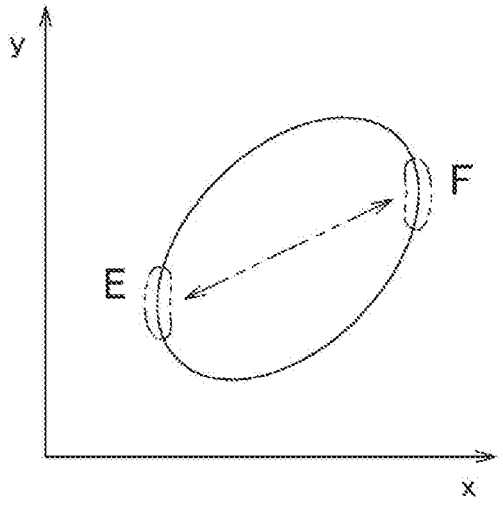
FIG. 16A is an illustrative diagram of the reference locus of the left massaging member, and other switching of partial segments of it, on the massage machine according to the third embodiment of the present invention.
Figure 16B:
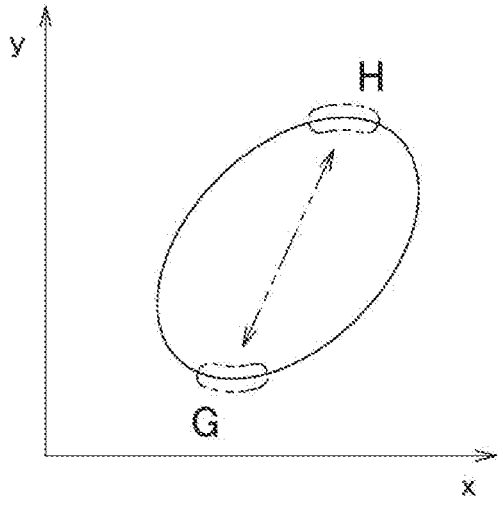
FIG. 16B is an illustrative diagram of the reference locus of the left massaging member, and yet other switching of partial segments of it, on the massage machine according to the third embodiment of the present invention.
Figure 16C:
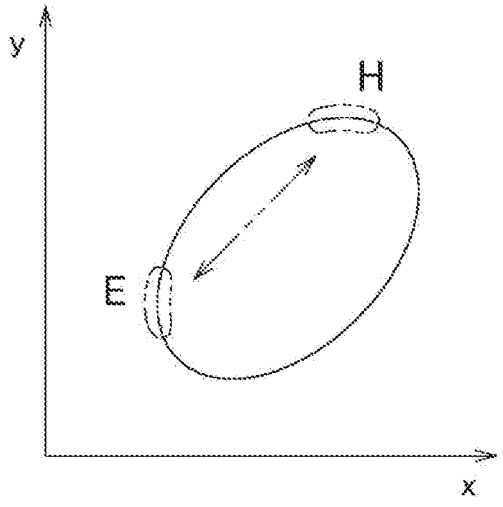
FIG. 16C is an illustrative diagram of the reference locus of the left massaging member, and still other switching of partial segments of it, on the massage machine according to the third embodiment of the present invention.

As shown in FIGS. 16A, 16B, and 16C, as the movement range within which the drive mechanism portion 60 makes the massaging members 51 perform a relative reciprocating movement, two or more predetermined partial segments may be set so as to include at least one of, of the reference locus, a left-end part along the left-right axis, a right-end part along the left-right axis, an upper-end part along the up-down axis, and a lower-end part along the up-down axis, all on the locus, so that switching is allowed between states where, of those segments, one predetermined partial segment is selected and another predetermined partial segment is selected respectively.

For example, as the movement range of the massaging members 51, of the reference locus, a partial segment E including a left-end part and a partial segment F including a right-end part both along the left-right axis on the locus are set, and switching is allowed between states where the partial segment E is selected and the state where the partial segment F is selected respectively (see FIG. 16A). For another example, a partial segment G including a lower-end part and a partial segment H including an upper-end part both along the up-down axis are set, and switching is allowed between states where the partial segment G is selected and the state where the partial segment H is selected respectively (see FIG. 16B). For another example, a partial segment E including a left-end part along the left-right axis and a partial segment H including an upper-end part along the up-down axis are set, and switching is allowed between states where the partial segment E is selected and the state where the partial segment H is selected respectively (see FIG. 16C).

In these examples, as the movement range of the massaging members 51, switchable selection is allowed between, of the reference locus, a predetermined partial segment including a one-end portion along the left-right or front-rear axis and a predetermined partial segment including an other-end portion along the left-right or front-rear axis both on the locus. This makes it possible to change the position at which the massaging members 51 perform a massage by moving it from end to end as seen from the user within the range of the reference locus. It is thus possible, without position adjustment of the massaging members involving their being moved together with the entire drive mechanism portion 60, to perform a massage while greatly changing the target area of the massage with the massaging members 51 simply by switching segments that are used as the range for relative movement of the massaging members 51. It is then possible to administer a massage to a plurality of different massage areas without requiring operation of a plurality of mechanisms involved in position adjustment of the massaging members 51.

Overview

The massage machine described above is a massage machine that includes in a backrest portion a massage mechanism with a massaging member and that can administer with the massaging member a massage to a user while supporting the user's body at least on the backrest portion. The massage machine includes: a drive mechanism portion that has a stationary portion movably supporting the massaging member and that makes the massaging member perform a relative motion relative to the stationary portion repeatedly such that the massaging member describes in space a reference locus which is a predetermined closed curve for a kneading massage; an ascent-descent mechanism that adjustably moves up and down the position of the massaging member along the backrest portion together with the entire drive mechanism portion; and a controller that is configured to control the operation of the drive mechanism portion and the ascent-descent mechanism. The controller is configured to control the drive mechanism portion to make the massaging member perform a relative reciprocating movement relative to the stationary portion within a partial movement range corresponding to a partial segment of the reference locus. The controller is configured also to control the ascent-descent mechanism to make the massaging member and the drive mechanism portion perform an up-down movement in coordination with the relative reciprocating movement of the massaging member such that the movement produced by the drive mechanism portion and the movement produced by the ascent-descent mechanism are combined together to produce an actual motion of the massaging member so as to describe a locus which is a curve different from the reference locus.

With this configuration, it is possible to administer the motion of the massaging member to a smaller area compared with an ordinary kneading massage and, as by applying a series of smaller kneading motions (press-and-knead) compared with an ordinary kneading massage, to apply a stimulus that an ordinary kneading massage does not offer, leading to an efficient massage. It is thus possible to further promote, with a massage, alleviation of stiffness and pain in muscles, fatigue reduction, and so forth, and also to increase the variety of massages, catering better to the user's preferences.

In the massage machine described above, as necessary, the controller can be configured to use, as the movement range within which the drive mechanism portion makes the massaging member perform the relative reciprocating movement, a predetermined partial segment of the reference locus of which the front-rear position on the locus is frontward and close to the user.

With this configuration, it is possible, without generally practiced front-rear position adjustment of the massaging member involving its being moved together with the entire drive mechanism portion, to obtain a state where the massaging member is brought close to the user and, while this state where the massaging member is located close to the user is maintained, to perform a massage without much moving the massaging member along the front-rear axis; it is thus possible to administer a massage with a substantially constant intensity of pressure to an area smaller than the target area of an ordinary kneading massage. In this way, it is possible, without front-rear position adjustment of the massaging member, to apply a sufficient stimulus with the massaging member and to perform a comfortable massage with suppressed variation of stimulus reliably without strain, applying the stimulus efficiently and adequately In the massage machine described above, as necessary, the controller can be configured to allow switching between a state where the controller chooses, as the movement range within which the drive mechanism portion makes the massaging member perform the relative reciprocating movement, a predetermined partial segment of the reference locus that includes the frontmost position closest to the user and a state where the controller chooses, as the movement range within which the drive mechanism portion makes the massaging member perform the relative reciprocating movement, a predetermined partial segment of the reference locus that includes the rearmost position farthest the user.

With this configuration, it is possible, without generally practiced front-rear position adjustment of the massaging member involving its being moved together with the entire drive mechanism portion, to switch positions of the massaging member simply by setting segments that are used as the range for relative movement of the massaging member. It is thus possible to easily change the intensity of the massage administered to an area smaller than the target area of an ordinary kneading massage, and thus to easily perform a massage with an adequate intensity adjusted to suit the situation without requiring operation of a plurality of mechanisms involved in position adjustment of the massaging member.

In the massage machine described above, as necessary, the controller can be configured to set, as the movement range within which the drive mechanism portion makes the massaging member perform the relative reciprocating movement, two or more predetermined partial segments including at least one of, of the reference locus, a left-end part, a right-end part, an upper-end part, and a lower-end part on the locus, so as to allow switching between a state where the controller chooses one of the set predetermined partial segments and a state where the controller chooses the other of the set predetermined partial segments.

With this configuration, it is possible to vary the position at which the massaging member performs a massage by moving it from end to end as seen from the user within the range of the reference locus. It is thus possible, without position adjustment of the massaging member involving its being moved together with the entire drive mechanism portion, to perform a massage while greatly changing the target area of the massage with the massaging member simply by switching segments that are used as the range for relative movement of the massaging member. It is then possible to administer a massage to a plurality of different massage areas without requiring operation of a plurality of mechanisms involved in position adjustment of the massaging member.

In the massage machine described above, as necessary, the controller can be configured to control the drive mechanism portion and the ascent-descent mechanism such that the movement produced by the drive mechanism portion and the movement produced by the ascent-descent mechanism are combined together to produce the actual motion of the massaging member so as to describe one of a plurality of switchable loci of different sizes which are each a curve.

With this configuration, it is possible to easily change the target area of a massage with the massaging member. It is thus possible to administer a massage to an appropriate area that suits the situation, and to perform a massage efficiently, for example, to a limited target area as a human can by hand, leading to an enhanced massage effect.

In the massage machine described above, as necessary, the drive mechanism portion can includes, as a mechanism that moves the massaging member: a kneading shaft that is supported rotatably and that is driven to rotate by a predetermined drive source; an eccentric rotor portion that is formed integrally on the kneading shaft so as to be oblique relative to it; and a massaging member support arm that is fitted to the eccentric rotor portion so as to be rotatable relative to it and that has the massaging member fixed to an end portion of it so as to support the massaging member in a protruding state. For example, as the kneading shaft rotates, the eccentric rotor portion rotates eccentrically about the kneading shaft, and as the eccentric rotor portion rotates, the massaging member support arm fitted around the eccentric rotor portion swings continuously; this makes the massaging member on an end portion of the massaging member support arm perform repeatedly a relative motion so as to describe the reference locus.

With this configuration, the relative reciprocating movement of the massaging member within the range corresponding to the partial segment of the reference locus can be produced with the forward and backward rotation of the kneading shaft. Thus through two channels of control by the controller, that is, the control of the rotation of the kneading shaft and the control of the motion of the ascent-descent mechanism, the complex motion of the massaging member can be produced. It is thus possible to obtain a simple and highly reliable mechanism for a massage with the massaging member.

What is claimed is:

1. A massage machine including, in a backrest portion, a massage mechanism with a massaging member, for administering with the massaging member a massage to a user while supporting a body of the user at least on the backrest portion, the massage machine comprising:

a drive mechanism portion having a portion stationary to a drive mechanism, said stationary portion movably supporting the massaging member, the drive mechanism portion making the massaging member perform a relative motion relative to the stationary portion repeatedly such that the massaging member describes in space a reference locus which is a predetermined closed curve for a kneading massage;

an ascent-descent mechanism adjustably moving up and down a position of the massaging member along the backrest portion together with the entire drive mechanism portion; and a controller configured to control operation of the drive mechanism portion and the ascent-descent mechanism, wherein the controller is configured to control the drive mechanism portion to make the massaging member perform a relative reciprocating movement relative to the stationary portion within a partial movement range corresponding to a partial segment of the reference locus and control the ascent-descent mechanism to make the massaging member and the drive mechanism portion perform an up-down movement in coordination with the relative reciprocating movement of the massaging member such that the movement produced by the drive mechanism portion and the movement produced by the ascent-descent mechanism are combined together to produce an actual motion of the massaging member so as to describe a composite locus which is a curve different from the reference locus, the drive mechanism portion includes, as a mechanism that moves the massaging member:

a kneading shaft supported rotatably and driven to rotate by a predetermined drive source;

an eccentric rotor portion formed integrally on the kneading shaft so as to be oblique relative thereto;

a massaging member support arm fitted to the eccentric rotor portion so as to be rotatable relative thereto, the massaging member support arm having the massaging member fixed to an end portion thereof so as to support the massaging member in a protruding state, wherein as the kneading shaft rotates, the eccentric rotor portion rotates eccentrically about the kneading shaft, and as the eccentric rotor portion rotates, the massaging member support arm fitted around the eccentric rotor portion swings continuously, thereby making the massaging member on an end portion of the massaging member support arm perform repeatedly a relative motion so as to describe the reference locus, and the composite locus is an ellipse when viewed from the front.

2. The massage machine according to claim 1, wherein the controller is configured to use, as the movement range within which the drive mechanism portion makes the massaging member perform the relative reciprocating movement, a predetermined partial segment of the reference locus of which a front-rear position on the locus is frontward and close to the user.

3. The massage machine according to claim 1, wherein the controller is configured to allow switching between a state where the controller chooses, as the movement range within which the drive mechanism portion makes the massaging member perform the relative reciprocating movement, a predetermined partial segment of the reference locus that includes a frontmost position closest to the user and a state where the controller chooses, as the movement range within which the drive mechanism portion makes the massaging member perform the relative reciprocating movement, a predetermined partial segment of the reference locus that includes a rearmost position farthest the user.

4. The massage machine according to claim 1, wherein the controller is configured to set, as the movement range within which the drive mechanism portion makes the massaging member perform the relative reciprocating movement, two or more predetermined partial segments including at least one of, of the reference locus, a left-end part, a right-end part, an upper-end part, and a lower-end part on the locus and allow switching between a state where the controller chooses one of the set predetermined partial segments and a state where the controller chooses another of the set predetermined partial segments.

5. The massage machine according to claim 1, wherein the controller is configured to control the drive mechanism portion and the ascent-descent mechanism such that the movement produced by the drive mechanism portion and the movement produced by the ascent-descent mechanism are combined together to produce the actual motion of the massaging member so as to describe one of a plurality of switchable loci of different sizes which are each a curve.

6. The massage machine according to claim 1, wherein it is configured to perform a massage by press-and-knead, by moving the massaging member so that the actual motion of the massaging member so as to describe a locus which is a curve different from the reference locus describes composite loci that have a smaller area compared with an ordinary kneading massage.

7. The massage machine according to claim 1, wherein the reference locus describes the closed curve in all of xy-plane, xz-plane, and yz-plane in a three-dimensional space, wherein the x direction is left-right direction, the y direction is up-down direction, and the z direction is front-rear direction, wherein the partial segment is a range in which the massaging member can move in each of the left-right direction, the up-down direction, and the front-rear direction.

8. The massage machine according to claim 1, wherein the reference locus is an oval-shaped closed curve inclined with respect to the horizontal and vertical directions when viewed from the front.

* * * * *